US007101315B2

(12) United States Patent
Chuang et al.

(10) Patent No.: US 7,101,315 B2
(45) **Date of Patent: *Sep. 5, 2006**

(54) WRIST EXERCISER HAVING DISPLAY AND TRANSMISSION DEVICE

(76) Inventors: Yun Yu Chuang, 4F, No. 16, Alley 15, Lane 82, Da Yong Street, San Chong City, Taipei (TW); Ming Hung Lin, 2F, No. 24, Lane 178, Li Shyng Road Section 1, San Chong City, Taipei (TW)

( * ) Notice: Subject to any disclaimer, the term of this patent is extended or adjusted under 35 U.S.C. 154(b) by 290 days.

This patent is subject to a terminal disclaimer.

(21) Appl. No.: 10/721,882

(22) Filed: Nov. 26, 2003

(65) Prior Publication Data

US 2005/0113214 A1 May 26, 2005

(51) Int. Cl.
*A63B 21/22* (2006.01)
*A63B 23/14* (2006.01)
*A63B 1/24* (2006.01)

(52) U.S. Cl. ..... 482/44; 482/1; 482/2; 482/3; 482/49; 482/110; 482/902; 446/235; 446/242; 601/33

(58) Field of Classification Search ..... 482/1, 482/2, 44, 49, 110, 902; 446/233, 235, 236, 446/242, 243, 244; 601/33, 40
See application file for complete search history.

(56) References Cited

U.S. PATENT DOCUMENTS 5,150,625 A * 9/1992 Mishler ..... 446/233
5,353,655 A * 10/1994 Mishler ..... 446/233
5,800,311 A * 9/1998 Chuang ..... 482/44
6,039,679 A * 3/2000 Yu ..... 482/110
6,413,144 B1 * 7/2002 Williams ..... 446/484
6,527,675 B1 * 3/2003 Yu ..... 482/44
6,623,405 B1 * 9/2003 Chuang et al. ..... 482/44
6,761,611 B1 * 7/2004 Wood et al. ..... 446/175
6,770,012 B1 * 8/2004 Kuo ..... 482/44
6,816,137 B1 * 11/2004 Leja ..... 345/82
2003/0038762 A1 * 2/2003 Leja ..... 345/82
2005/0101454 A1 * 5/2005 Dworzan ..... 482/110
2005/0107218 A1 * 5/2005 Chuang et al. ..... 482/45
2005/0206218 A1 * 9/2005 Clifford et al. ..... 301/37.25

* cited by examiner

*Primary Examiner*—Stephen R. Crow
*Assistant Examiner*—Victor K. Hwang
(74) *Attorney, Agent, or Firm*—Rosenberg, Klein & Lee

(57) ABSTRACT

A wrist exerciser includes a casing comprised of upper and lower casing members mounted together to form a substantially spherical shape. A rotor has opposite shafts rotatably received in the holes defined in the casing for rotatably supporting the rotor in the casing. Illumination elements are mounted on an outside surface of the rotor. A power source is fixed in the rotor for powering the illumination elements. A control circuit is in electrical connection with the power source and the illumination elements for selectively lighting the illumination elements. A transmission device is mounted in the rotor and has an interface circuit connected to the control circuit and a socket connector in connection with the interface circuit. A transmission cable has opposite ends forming first and second connectors, wherein the first connector is mateable with the socket connector of the transmission device of the rotor and the second connector is engageable with for example a personal computer for transferring control programs from the external device to the control circuit.

18 Claims, 6 Drawing Sheets

WRIST EXERCISER HAVING DISPLAY AND TRANSMISSION DEVICE

BACKGROUND OF THE INVENTION

1. Field of the Invention

The present invention generally relates to a wrist exerciser that is held by a palm of a user and having an internal rotor that is caused to rotate by the user exercising his or her wrist muscles, and in particular to a wrist exerciser having display and transmission device for displaying and receiving images from an external device, such as a computer.

2. The Related Art

A wrist exerciser is employed to exercise and rehabilitate wrist-related muscles of a user. Apparent therapeutic result can be obtained in the user for rehabilitation purposes. Examples of the wrist exercisers are shown in Taiwan Utility Model No. 135058 and U.S. Pat. No. 5,800,311, both disclose wrist exercises in which wrist related muscles are well exercised by simply rotating the wrist exerciser with the wrist.

The conventional wrist exercisers have a simple structure and are operated by a user exercising his or her wrist muscles to cause rotation of an internal rotor. The rotation of the rotor induces centrifugal force that acts against the force of wrist muscles, realizing exerciser of the wrist muscles. Thus, the wrist exerciser is considered an exercising measure having only monotonic function of muscle exercising so that the wrist exerciser is generally not very appealing to the general consumers.

Wrist exercisers having display means are known, such as Taiwan Patent Publication No. 552982 and U.S. Pat. No. 6,623,405, both being filed in the name of the present inventor. Those conventional display-incorporated wrist exercisers, however, are still insufficient to attract the attention of the general consumers and thus, the present invention is aimed to further improve the wrist exerciser for the purpose of at least making the wrist exerciser more appealing to the general consumers.

SUMMARY OF THE INVENTION

Thus, a primary objective of the present invention is to provide a wrist exerciser comprising illumination elements mounted on an outside surface of an rotor for illumination and display purposes whereby a variety of images can be selectively displayed either in rotation of the rotor or when the rotor is still.

Another objective of the present invention is to provide a wrist exerciser comprising an internal rotor in which a power source and a control circuit are contained for controlling, in a programmable manner, lighting of illumination elements that display, in a dot-matrix manner, patterns or images, such as figures and characters.

A further objective of the present invention is to provide a wrist exerciser comprising transmission means for downloading display control programs from an external electronic device, such as a personal computer, to a control circuit mounted inside the wrist exerciser that controls the lighting of illumination elements and thus the display of images.

To achieve the above objectives, in accordance with the present invention, there is provided a wrist exerciser comprising a casing comprised of upper and lower casing members mounted together to form a substantially spherical shape. A rotor has opposite shafts rotatably received in the holes defined in the casing for rotatably supporting the rotor in the casing. Illumination elements are mounted on an outside surface of the rotor. A power source is fixed in the rotor for powering the illumination elements. A control circuit is in electrical connection with the power source and the illumination elements for selectively lighting the illumination elements. A transmission device is mounted in the rotor and has an interface circuit connected to the control circuit and a socket connector in connection with the interface circuit. A transmission cable has opposite ends forming first and second connectors, wherein the first connector is mateable with the socket connector of the transmission device of the rotor and the second connector is engageable with for example a personal computer for transferring control programs from the external device to the control circuit.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
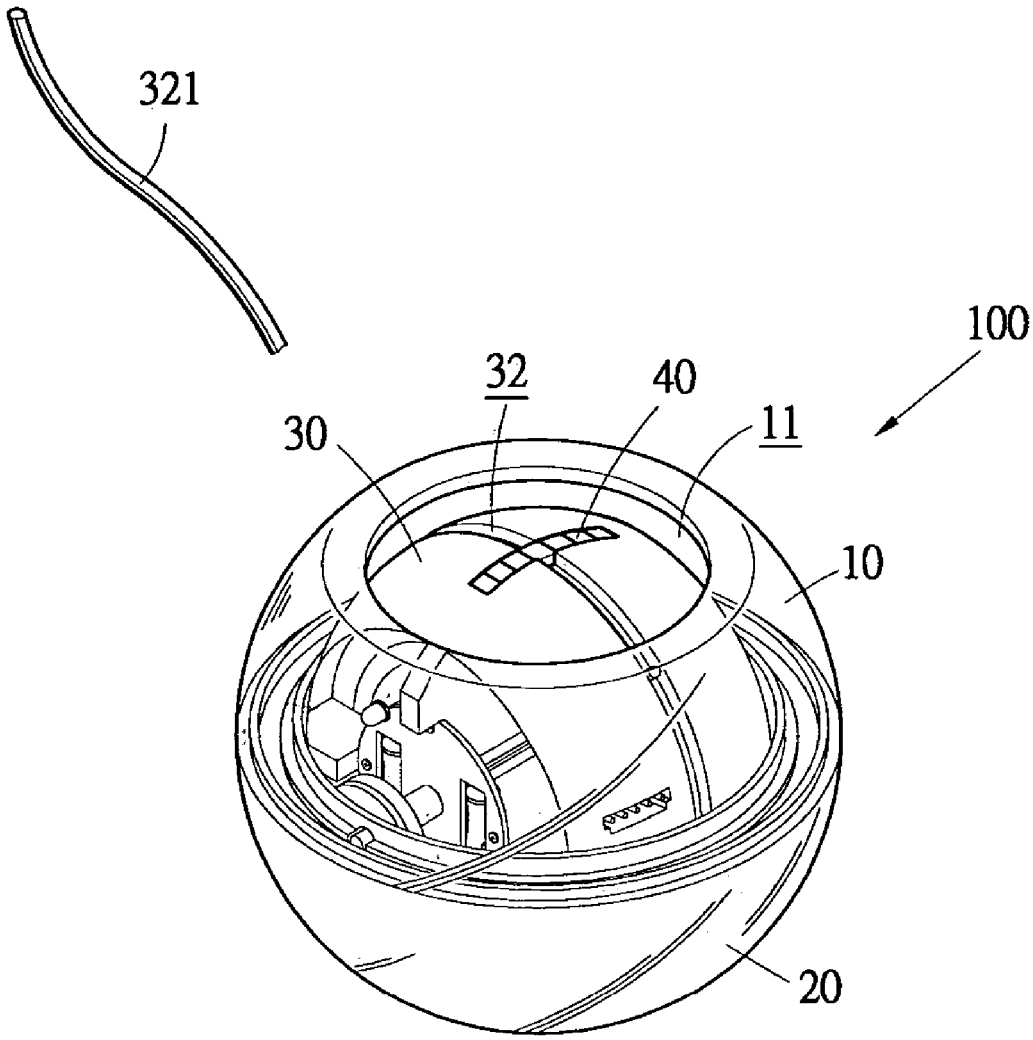
FIG. 1 is a perspective view of a wrist exerciser constructed in accordance with a first embodiment of the present invention.
Figure 2:
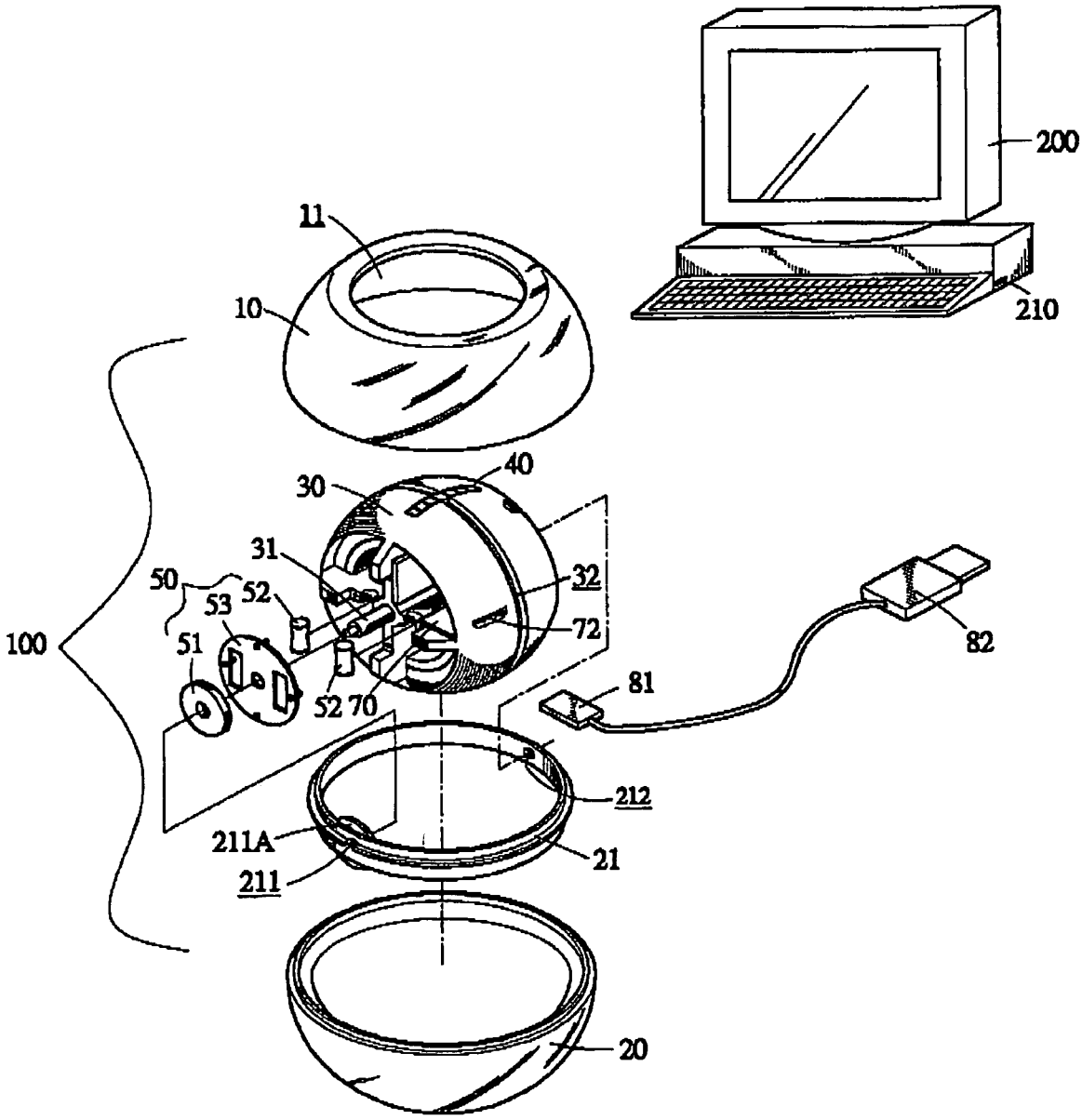
FIG. 2 is an exploded view of the wrist exerciser in accordance with the first embodiment of the present invention, together with a personal computer to which the wrist exerciser is connectable with transmission means.
Figure 3:
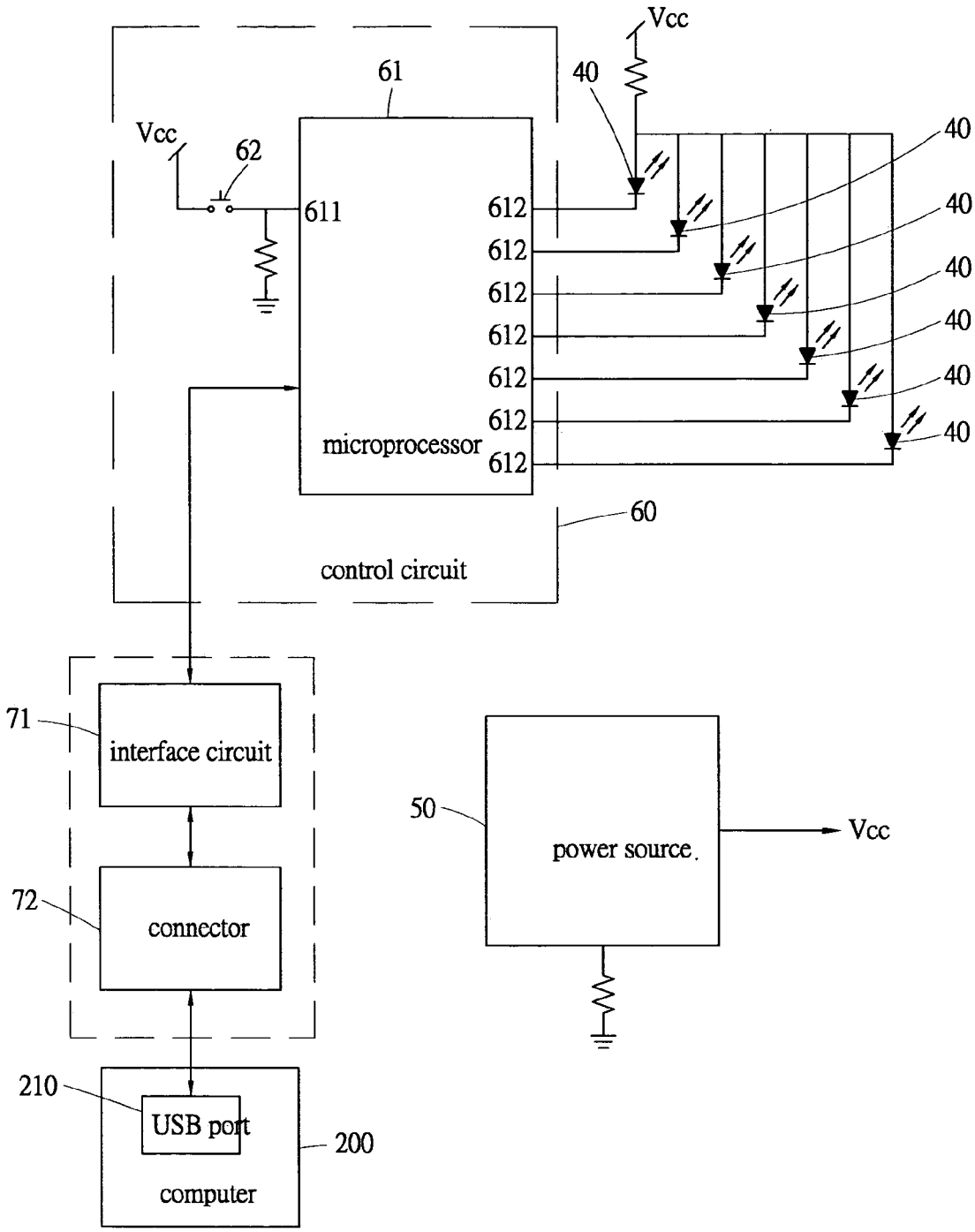
FIG. 3 is a block diagram of a control circuit of the wrist exerciser of the present invention.

With reference to the drawings and in particular to FIGS. 1–3, a wrist exerciser constructed in accordance with the present invention, generally designated with reference numeral .100 comprises a casing, substantially spherical in shape, comprised of an upper casing member 10 and a lower casing member 20, both being substantially hemispherical and mounted to each other to form the spherical casing. An opening 11 is defined in the upper casing member 10 and substantially opposite to the lower casing member 20. Preferably, the casing members 10, 20 are made of transparent material or light-transmitting material whereby the interior of the casing is visible by a user or a player of the wrist exerciser.

Inside the casing, a retention ring 21, substantially corresponding to a great circle of the sphere of the casing, is arranged and fixed by being partially interposed between the upper and lower casing members 10,20. The retention ring 21 defines diametrically opposite and coaxially aligned holes 211, 212. A mounting flange 211A is formed around the hole 211.

An internal rotor 30, also having a substantially spherical configuration, has two coaxial shafts 31 extending from opposite sides of the rotor 30 and rotatably received in the holes 211, 212 of the retention ring 21. Thus, the rotor 30 is maintained rotatable inside the casing and substantially between the upper and lower casing members 10, 20 by means of the rotatable joint between the retention ring 21 and the shafts 31 of the rotor 30.

The rotor 30 forms a circumferential groove 32 substantially corresponding to a great circle of the rotor 30. A wire 321 extends into the casing through the opening 11 of the upper casing member 10 and is manually wound around the groove 32 of rotor 30. By forcibly pulling and thus unwinding the wire 321 from the rotor 30, the friction force between the rotor 30 and the wire 321 drives an initial rotation of the rotor 30 inside the casing. It is noted that using a wire 321 to cause initial rotation of the rotor 30 is only an illustrative example, other manner that causes an initial rotation of the rotor 30 may be employed.

On an outside surface of the rotor 30 that faces an inside surface of the casing, a plurality of illumination elements 40 is mounted. An example of the illumination element 40 is light emitting diode (LED). However, other devices that emit light when electrically energized may also be employed in the present invention. The illumination elements 40 can be arranged in any forms, such as a figure and a character, or preferably arranged in a one-row or multiple-row array, just like a dot-matrix type display device.

A power source 50 and a control circuit 60 are contained or embedded in the rotor 30 and in electrical connection with each other and the illumination elements 40 for powering and controlling the lighting of the illumination elements 40. The power source 50 can be of any known type, such as a direct current (DC) generator illustrated in the drawings, which comprises a permanent magnet 51 and at least a winding 52. The magnet 51, in the form of a ring, is mounted to and supported by the mounting flange 211 A of the retention ring 21 with the shaft 31 of the rotor 30 extending through the magnet 51. The winding 52 is mounted to the rotor 30 at a position opposing the magnet 51 whereby when the rotor 30 rotates, the winding 52 cuts through the magnetic lines of force of the magnet 51, inducing alternative current in the winding 52. The alternative current is supplied through a rectification and regulation circuit 53, which is embedded in the rotor 30, and converted into direct current of desired voltage to power the illumination elements 40 and the control circuit 60.

The control circuit 60 controls the lighting of the illumination elements 40. The control circuit 60 can be of any type, such as a microprocessor based programmable controller comprising a microprocessor 61 and a selection switch 62 as illustrated in FIG. 3. A control program for selectively lighting each of the illumination elements 40 may be preloaded in the microprocessor 61. Alternatively, a number of control programs for lighting the illumination elements 40 in different manners are loaded in the microprocessor 61. An input 611 of the microprocessor 61 is connected to the selection switch 62 whereby each time the selection switch 62 is triggered, the microprocessor 61 switches, preferably in sequence but not need to be so, among the control programs. Thus, the microprocessor 61 may control the fashion of lighting the illumination elements 40 based on the selection of a user.

The microprocessor 61 has output terminals 612 respectively connected to each illumination element 40. Once an actuation signal, such as a low level of voltage, is applied to a specific one of the output terminals 612, the particular illumination element 40 that is connected to the specific one of the output terminals 612 is lit, giving off light. When a high level of voltage is applied to the output terminal 612, the illumination element 40 is put off. By this way, the microprocessor 61 selectively applies high and low levels to each illumination element 40 in accordance with a specific control program and in case the illumination elements 40 are arranged in an array, patterns and characters can be displayed by lighting proper ones of the illumination elements 40.

Alternatively, transmission means may be provided to selectively download control programs from an external device, such as a personal computer 200, to the microprocessor 61. The transmission means comprises a transmitter 70 embedded in the rotor 30 and comprised of an interface circuit 71 and a connector 72. The connector 72 is connected to the microprocessor 61 of the control circuit 60 by the interface circuit 71. The interface 71 can be any known interfaces, such as universal serial bus (USB) interface that is employed in the embodiment illustrated. However, other data transmission interface can be adopted alternatively and additionally. In the example illustrated, the connector 72 comprises a mini USB connector, which serves as a communication port of the microprocessor 61 with the personal computer 200.

A transmission cable 80 having opposite ends respectively forming first and second connectors 81, 82. The first and second connectors 81, 82 of the cable 80 can be of any types but are mateable with the connector 72 of the interface circuit 71 and a counterpart connector 210 formed in the computer 200 for establishing a communication channel between the microprocessor 61 and the computer 200. For example, the connector 72 of the interface circuit 71 is a mini USB socket connector, while the first connector 81 of the cable 80 is a mateable mini USB plug connector. Similarly, the second connector 82 of the cable 80 can be a USB plug connector, while the computer connector 210 is a USB socket connector. The microprocessor 61 can be connected to the computer 200 for example at the time the wrist exerciser 100 is being manufactured (when the upper and lower casing members 10, 20 are not fixed together) for downloading the control programs to the microprocessor 61. Alternatively, the cable 80 can be connected to an assembled wrist exerciser 100 via the opening 11 defined in the upper casing member 10 when the rotor 30 is still. This allows a user to load any desired control programs and images to be displayed from an external device, such as the personal computer 200, to the microprocessor 61.

The cable 80 that forms USB connection with both the microprocessor 61 and the computer 200 allows the microprocessor 61 to be powered by the computer 200 whereby no built-in power source in the wrist exerciser 100 is needed or the microprocessor 61 operates when the DC generator does not generate power. Thus the computer 200 supplies power through the cable 80 to the microprocessor 61 when the microprocessor 61 is connected to the computer 100 and the rotor 30 is still, namely not rotating and thus no power generated by the DC generator.

Figure 4:
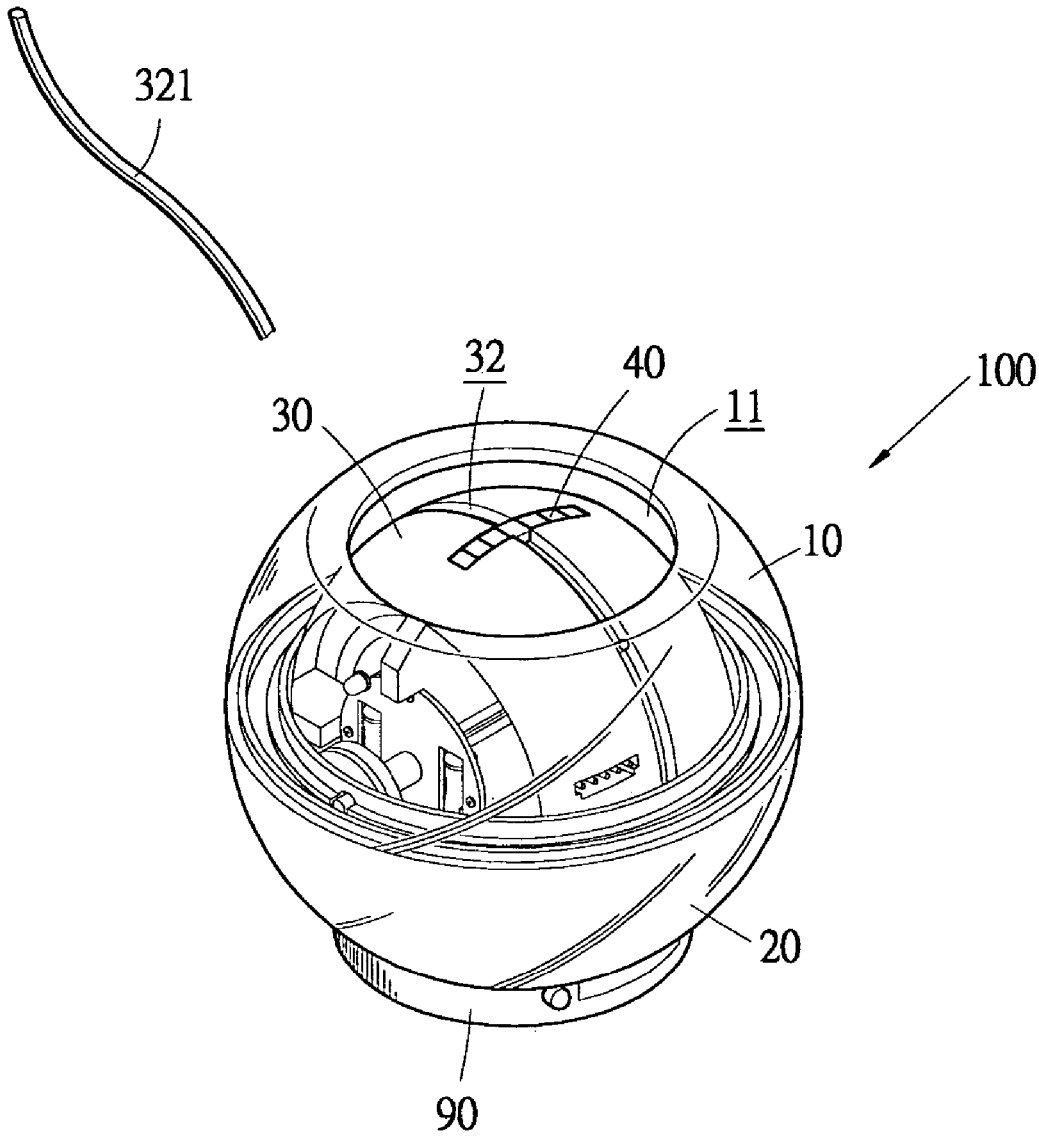
FIG. 4 is a perspective view of a wrist exerciser constructed in accordance with a second embodiment of the present invention.
Figure 5:
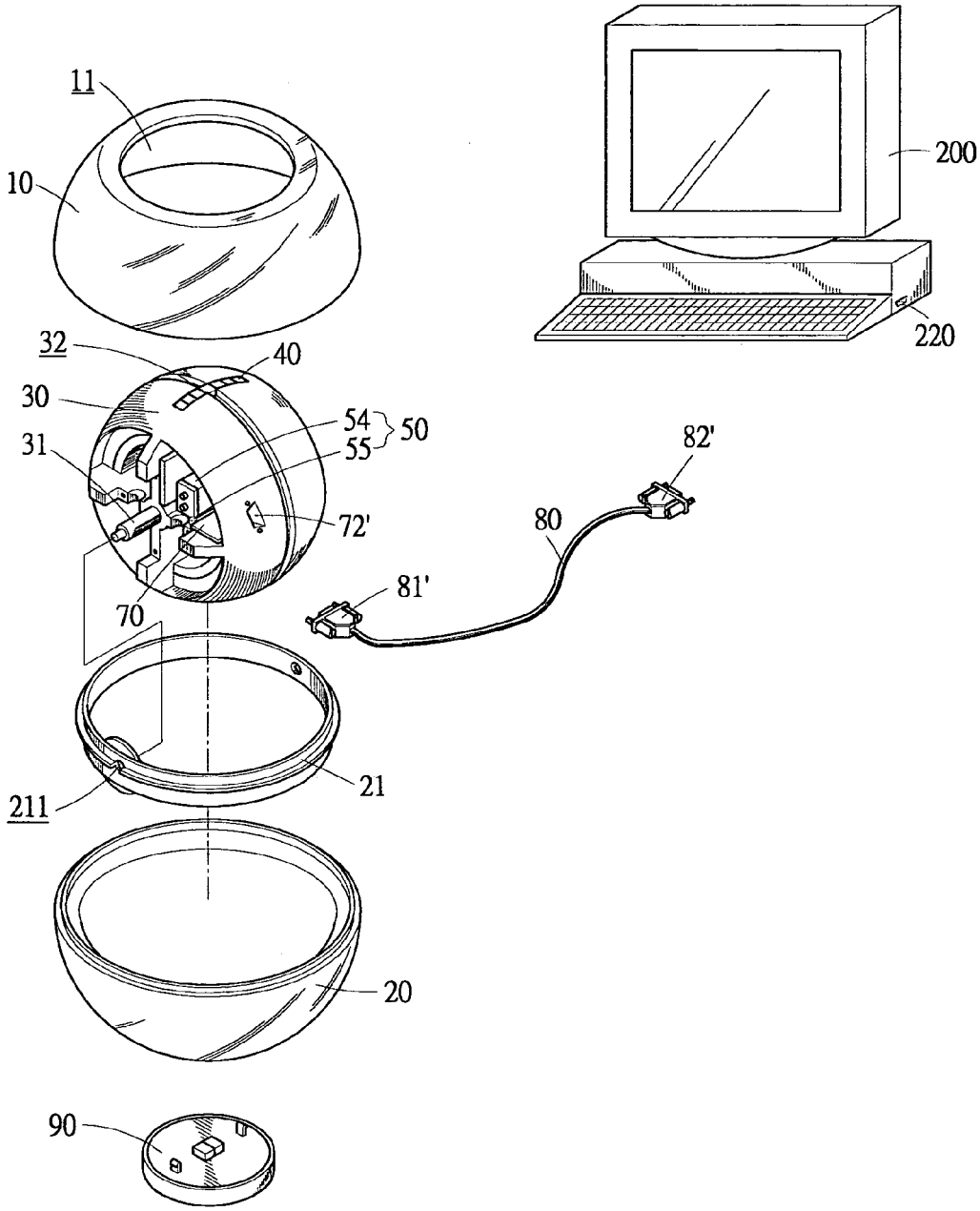
FIG. 5 is an exploded view of the wrist exerciser in accordance with the second embodiment of the present invention, together with a personal computer to which the wrist exerciser is connectable with transmission means.

FIGS. 4 and 5 show another embodiment of the wrist exerciser 100 of the present invention. In the second embodiment of the wrist exerciser 100, the power source 50 comprises a battery 54 and a switch 55 for selectively supplying power to the microprocessor 61 when the rotor 30 is still and not in rotation. The DC generator involved in the previous embodiment is thus omitted. The battery 54 also powers the illumination elements 40 when the rotor 30 is not rotating. This allows display of image when the rotor 30 is not rotating.

Furthermore, the interface circuit of the rotor 30, which is USB based interface in the previous embodiment, is embodied as an RS232 interface 71 having an RS232 connector 72'. Opposite ends of the cable 80 are formed with RS232connectors 81', 82' for respectively engaging the RS232 connector 72' of the interface circuit 71 and an RS232 connector 220 of the computer 200. Thus, data and programs can be downloaded to the microprocessor 61 via the RS232 cable 80 and the RS232 connection thereof with the computer 200 and the microprocessor 61. The microprocessor 61 is powered by the battery 54 of the power source 50.

In addition, if desired, a counter 90, preferably an electronic counter, is mounted to the lower casing member 20 for counting and displaying the number of turns of the rotation of the rotor 30. The counter 90 may be independently powered. In other words, the counter 90 may comprise a separate power source different from the power source 50 of the rotor 30.

Figure 6:
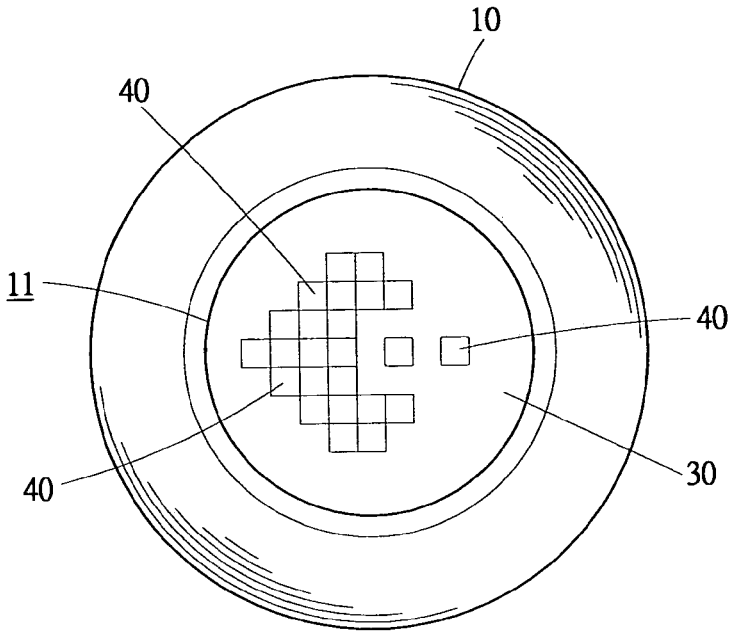
FIG. 6 is a plan view showing a first example of displaying a pattern on an internal rotor of the wrist exerciser of the present invention.

Also referring to FIG. 6, when the rotor 30 is in rotation, the power source 50 supplies electrical power to the microprocessor 61 and the illumination elements 40. The microprocessor 61 turns on/off each illumination element 40 based on the control program loaded therein. Due to the persistence of vision of human eyes, dynamic and/or static images can be displayed on the illumination elements 40 if the rotor 30 is of sufficient rotation speed. The image can be viewed by a player through the opening 11 of the upper casing member 10. Alternatively, in case the casing is made transparent, the image can be viewed through the casing.

Figure 7:
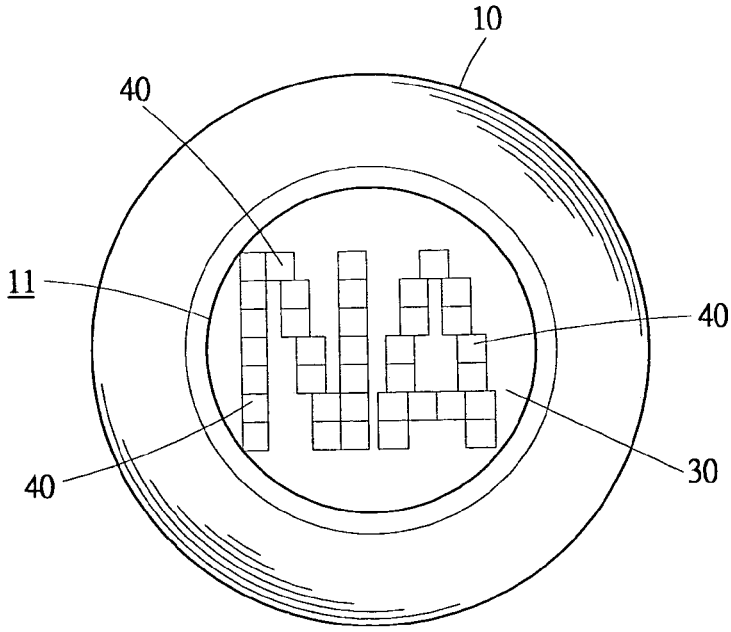
FIG. 7 is another plan view showing a second example of displaying a pattern on an internal rotor of the wrist exerciser of the present invention.

FIG. 7 shows a different application of the present invention wherein the illumination elements 40 are lit in such a manner under the control of the control circuit 60 that the image displayed is scrolling leftward or rightward. A cyclic display of information is provided.

With the selective connection of the microprocessor 61 with the personal computer 200, data and information to be displayed, as well as different schemes of display (denoted by different control programs), can be downloaded into the microprocessor 61 via the transmission cable 80. In addition, the information that is being displayed can be modified by the user by means of the computer 200. Thus, new figures, texts and other marks and information can be periodically updated.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A wrist exerciser comprising:

a casing comprising upper and lower casing members mounted together to form a substantially spherical shape, the upper casing member defining an opening;

a retention ring fixed in the casing substantially corresponding to a great circle of the sphere of the casing, diametrically opposite holes being defined in the retention ring;

a rotor having opposite shafts rotatively received in the holes for rotatively supporting the rotor in the casing;

at least one illumination element mounted on an outside surface of the rotor;

a power source contained in the rotor;

a control circuit contained in the rotor and in electrical connection with the power source and the illumination element, the control circuit selectively lighting the illumination element; and transmission means comprising:

a transmitter mounted in the rotor and comprising an interface circuit connected to the control circuit and a connection member in connection with the interface circuit, and a transmission cable having opposite ends forming first and second connectors, the first connector being releasably mateable with the connection member of the transmitter of the rotor and the second connector being adapted to connect an external device for transferring an electrical signal from the external device to the control circuit.

2. The wrist exerciser as claimed in claim 1, wherein the upper and lower casing members are made of light transmitting material.

3. The wrist exerciser as claimed in claim 1, wherein the rotor defines a circumferential groove.

4. The wrist exerciser as claimed in claim 1, wherein the illumination element comprises a light emitting diode.

5. The wrist exerciser as claimed in claim 1, wherein the power source comprises:

a permanent magnet attached to the retention ring;

a winding mounted to the rotor and substantially opposing the permanent magnet whereby when the rotor rotates, the winding cuts though magnetic lines of force of the magnet thereby inducing an electrical current in the winding; and a rectification and regulation circuit receiving and processing the electrical current to supply electrical power to the illumination element and the control circuit.

6. The wrist exerciser as claimed in claim 5 further comprising a mounting flange formed around one of the holes of the retention ring and wherein the permanent magnet comprises a ring mounted to and supported by the mounting flange with the shaft of the rotor extending through the ring of the magnet.

7. The wrist exerciser as claimed in claim 1, wherein the power source comprises a battery and a switch that selectively connects the battery to the control circuit and the illumination element to power the control circuit and the illumination element.

8. The wrist exerciser as claimed in claim 1, wherein the control circuit comprises programmable means.

9. The wrist exerciser as claimed in claim 1, wherein the control circuit comprises a microprocessor comprising an output terminal connected to the illumination element, the microprocessor comprising a control program for selectively lighting the illumination element by sending an electrical signal at the output terminal.

10. The wrist exerciser as claimed in claim 9, wherein the microprocessor comprises a number of different control programs and a selection switch for selecting one of the control programs with which the microprocessor lights the illumination element.

11. The wrist exerciser as claimed in claim 1, wherein the interface circuit comprises a Universal Serial Bus (USB) based interface.

12. The wrist exerciser as claimed in claim 1, wherein the interface circuit comprises an RS232 interface.

13. The wrist exerciser as claimed in claim 1, wherein the connection member of the rotor comprises a mini USB socket connector while the first connector of the transmission cable is a mini USB plug connector.

14. The wrist exerciser as claimed in claim 1, wherein the connection member of the rotor comprises an RS232 connector.

15. The wrist exerciser as claimed in claim 1, wherein the first connector of the transmission cable comprises a mini USB plug connector.

16. The wrist exerciser as claimed in claim 1, wherein the first connector of the transmission cable comprises a USB plug connector.

17. The wrist exerciser as claimed in claim 1, wherein the first connector of the transmission cable comprises an RS232 connector.

18. The wrist exerciser as claimed in claim 1 further comprising an electronic counter mounted to the casing.

* * * * *